US006270078B1

(12) United States Patent
Leone et al.

(10) Patent No.: US 6,270,078 B1
(45) Date of Patent: Aug. 7, 2001

(54) METHOD OF PLAYING AN IMPROVED VERSION OF THE GAME OF PAI GOW POKER

(76) Inventors: Anthony Leone; Santos Calderon, both of 304 Dorchester Dr., Egg Harbor Township, NJ (US) 08234

( * ) Notice: Subject to any disclaimer, the term of this patent is extended or adjusted under 35 U.S.C. 154(b) by 0 days.

(21) Appl. No.: 09/251,213

(22) Filed: Feb. 16, 1999

(51) Int. Cl.[7] ..... A63F 1/00
(52) U.S. Cl. ..... 273/292
(58) Field of Search ..... 273/292, 274; 463/13

(56) References Cited

U.S. PATENT DOCUMENTS

| | | | |
|---|---|---|---|
| 5,224,706 | 7/1993 | Bridgeman et al. | 463/13 |
| 5,226,661 | 7/1993 | Wolf | 273/274 |
| 5,248,142 | 9/1993 | Breeding | 273/138 R |
| 5,249,809 | 10/1993 | Wolf | 273/274 |
| 5,265,882 | 11/1993 | Malek | 273/292 |
| 5,314,194 | 5/1994 | Wolf | 273/292 |
| 5,580,061 | 12/1996 | Kong | 273/292 |
| 5,584,486 | 12/1996 | Franklin | 273/292 |

OTHER PUBLICATIONS

Pai Gow Poker Tommy's Way, Thomas L. Franklin, Gambler's Bookstore, 1989.*

* cited by examiner

*Primary Examiner*—Benjamin H. Layno
(74) *Attorney, Agent, or Firm*—Norman E. Lehrer

(57) ABSTRACT

An improved version of the game Pai Gow Poker allows a player to bet against the house and/or to bet against the other players. In addition to the conventional betting spot for placing a bet against the banker, an additional betting spot is located in front of each of the players which allows the player to bet against the house. This can be done whether or not the house is the banker. Thus, even if a fellow player has been designated as the banker, each other player can still choose to play against only the house. Each player can, of course, play against his or her fellow player/banker but is not required to do so. Each player can play against the house, against his or her fellow player/banker, against neither or against both.

2 Claims, 2 Drawing Sheets

METHOD OF PLAYING AN IMPROVED VERSION OF THE GAME OF PAI GOW POKER

BACKGROUND OF THE INVENTION

The present invention is directed toward the game of Pai Gow Poker and more particularly toward a method of playing an improved version of the game of Pai Gow Poker which is intended to make the game more interesting and to increase revenues for casinos.

Although the game of Pai Gow Poker, frequently referred to as Asian Poker, has been around for many years, it has only recently gained wide spread acceptance in gambling casinos throughout the United States. As is well known in the art, the game is played with either tiles or with a standard deck of 52 playing cards. In some versions of the game, a joker is also utilized although the same normally can be used to represent only a limited number of cards such as an ace or as part of a straight or flush. Rankings in Pai Gow Poker are substantially the same as rankings in other types of poker games.

Pai Gow Poker is typically played in a casino at a table much like that utilized for Blackjack or Baccarat or the like. That is, there is a dealer position and six player positions equally spaced around the perimeter of the table. At each player position, there are normally markings or indicia for the dealer's high and low hands (to be explained hereinafter) and a spot for each player to place his or her ante or bet.

The game is typically started by each player placing a bet. The dealer then deals seven cards to himself and to each of the six player positions. Each player, including the dealer, then forms two hands from his holding of seven cards. One hand, referred to as the low hand, consists of two of the dealt cards. The other hand, referred to as the high hand, consists of the remaining five cards that were dealt to that player.

The only requirement in forming the high and low hands is that the low hand must be of a lower rank than the high hand. The ranking of the hands is similar to traditional poker with the exception as pointed out above that the joker can be used to represent an ace or to represent any one card of either a straight or a flush. Thus, the highest possible hand is five aces.

If the player's low hand and high hand are higher in rank than the low and high hand of the dealer or banker, the player is a winner and the banker loses. However, if the dealer or banker's hands are higher than the player's, the player is a loser and the banker wins. The banker's hand is normally considered to be the winner in the event of a tie.

If the player's low hand is of a higher rank than the banker's low hand but the player's high hand is of a lower rank than the banker's high hand, neither wins and there is considered to be a push. Similarly, a push exists when a player's low hand is of a lower rank than the banker's low hand and the player's high hand is of a higher rank of the banker's high hand. There is, therefore, no winner when a push exists.

In some casinos, the banker and the dealer are one and the same and is employed by the casino. The dealer is employed by the casino and deals the cards but is also a player. More frequently, however, the players are given an option, in turn, to be the banker and each of the other players would then play against the banker/player. (The banker is the dealer or player who is responsible for paying or collecting from each of the players.) When this is done, the house, that is, the establishment operating the game, takes a commission by way of a percentage on all winning wagers.

Many players, however, do not wish to play against their fellow players. Rather, they would prefer to simply play against the house. Thus, when a player is designated the banker, other players frequently pass or sit out since they do not want to play against a fellow player. They will frequently sit out until the house is again the banker. As a result, the house may lose substantial revenues since there are fewer winning wagers and, therefore, fewer commissions to be paid the house. Furthermore, the players may become bored while they are sitting out waiting for the house to again be the banker.

SUMMARY OF THE INVENTION

The present invention is designed to overcome the deficiencies of the prior art described above. The improved version of the game Pai Gow Poker described herein allows a player to bet against the house and/or to bet against the other players. In addition to the betting spot for placing a bet against the banker, an additional betting spot is located in front of each of the players which allows the player to bet against the house. This can be done whether or not the house is the banker. Thus, even if a fellow player has been designated as the banker, each other player can still choose to play against only the house. Each player can, of course, play against his or her fellow player/banker but he or she is not required to do so. Each player can play against the house, against his or her fellow player/banker, against neither or against both.

BRIEF DESCRIPTION OF THE DRAWINGS

For the purpose of illustrating the invention, there is shown in the accompanying drawing one form which is presently preferred; it being understood that the invention is not intended to be limited to the precise arrangements and instrumentalities shown.

DETAILED DESCRIPTION OF THE PREFERRED EMBODIMENT

Figure 1:
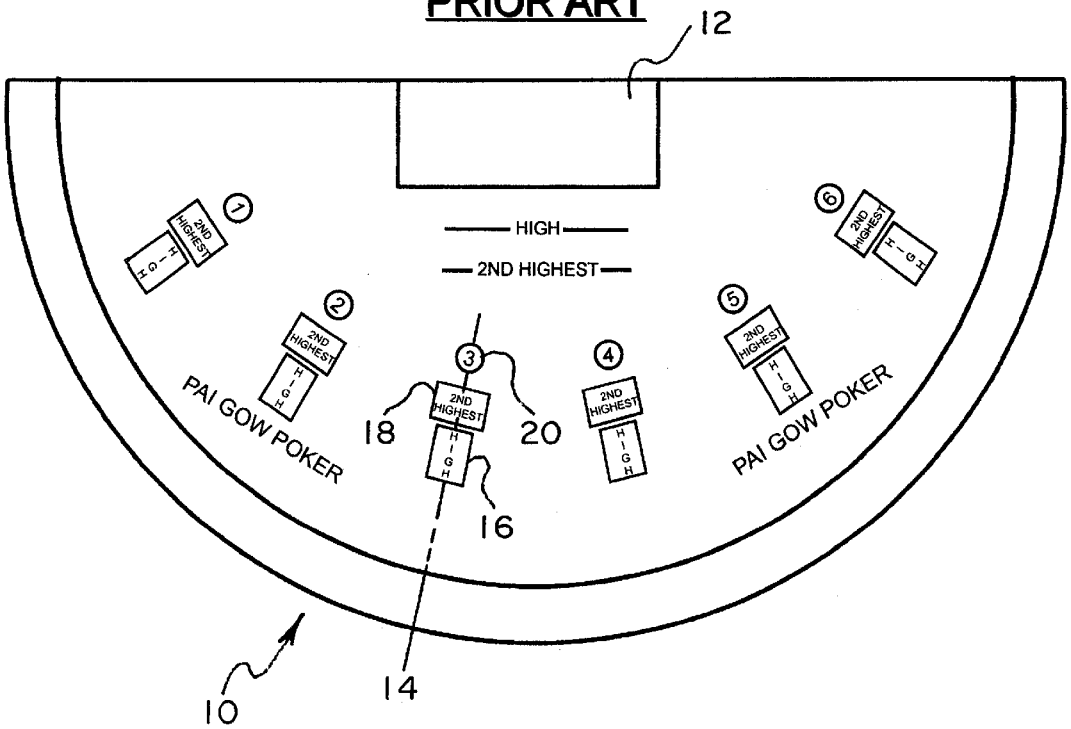
Fig. 1 PRIOR ART
FIG. 1 is a plan view of a gaming table top showing a conventional Pai Gow Poker game.

Referring now to the drawings in detail wherein like reference numerals have been used throughout the various figures to designate like elements, there is shown in FIG. 1 a standard layout for a Pai Gow Poker game as played in many casinos. FIG. 1 has been designated as "Prior Art" as it does not include the improvements of the present invention but is simply included to illustrate a standard Pai Gow Poker game which is well known in the art.

The standard Pai Gow Poker game is played on a table 10 and includes a dealer position 12 and six player positions as shown, for example, at position 14. Each player position includes groups of player station indicia which are well known. For example, the indicia 16 in the form of a vertical box is normally utilized by the player to place the five cards representing the player's high hand while the indicia in the form of the horizontal box 18 is normally used by the player to place the two cards representing his or her second highest hand (sometimes referred to as the low hand). The indicia in the form of the circle 20 is where the player normally places his or her bet against the banker which is placed, of course, prior to the cards being dealt.

Figure 2:
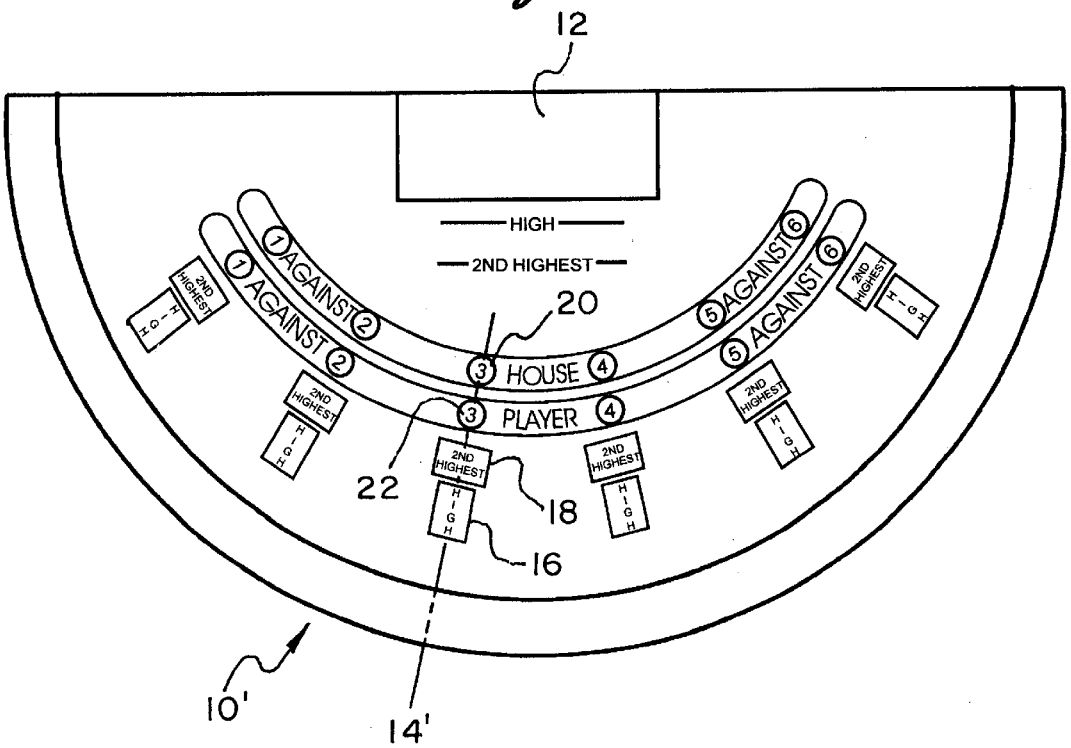
FIG. 2 is a plan view similar to FIG. 1 incorporating the improvements of the present invention.
Figure 3:
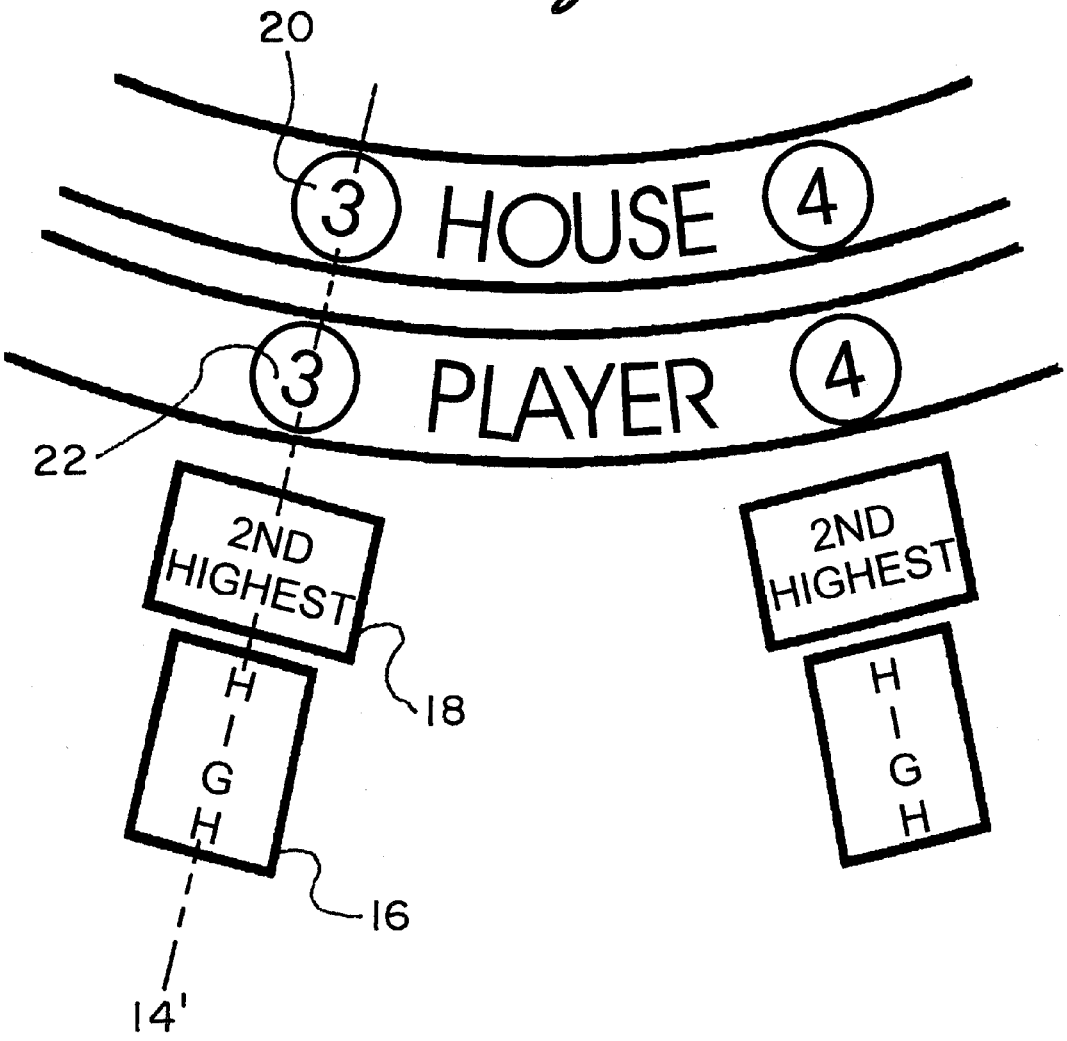
FIG. 3 is an enlarged view of a portion of FIG. 2 showing the details of one of the player positions.

FIG. 2 illustrates one embodiment of the improved Pai Gow Poker game of the present invention. The layout 10' shown in FIG. 2 is similar to the layout 10 shown in FIG. 1 in that it includes a dealer position 12 and a plurality of additional player positions such as shown at 14'. Each player position also includes indicia 16 in the form of a box wherein the player will place the five cards representing his or her high hand and indicia in the form of a box 18 wherein the player would place the two cards representing his or her second highest hand.

Each player position will also include indicia such as a circle 20 wherein the player may place a bet against the house. However, each player position also includes a second betting indicia in the form of a circle 22 wherein the player may place a bet against the banker. Of course, if the house is also the banker, the player would place only one bet.

By having two separate betting areas 20 and 22, each player can decide before any of the cards are dealt whether he or she wishes to play against only the house, only a player/banker, against neither or against both. If the player plays against only the house, his or her cards will be compared only against the dealer's cards and a winner will be determined in a conventional manner. Similarly, if the player decided to play only against his fellow player/banker, his or her cards would be compared to the player/banker's cards and the winner would be again determined in the conventional manner. Similarly, if the player decided to play against both the house and the player/banker, winners or losers would be decided against both the dealer and against the fellow player/banker.

It should be readily apparent to those skilled in the art that utilizing the improved Pai Gow Poker game of the present invention does not change the manner in which the game is played. Bets are first made before any cards are dealt. The cards are then dealt in a conventional manner and all hands are arranged in a conventional Pai Gow Poker manner. It is believed that the house and player advantages or disadvantages relative to the inventive game do not vary from the conventional game of Pai Gow Poker. However, should it be determined that there are advantages or disadvantages from a statistical standpoint, or if the house or a regulatory authority believes that changes are necessary, the payout and/or commissions to be paid to the house based on any such different statistical probabilities of winning or losing can be adjusted accordingly. This, however, does not change the play of the inventive game as described above.

The present invention may be embodied in other specific forms without departing from the spirit or essential attributes thereof and accordingly, reference should be made to the appended claims rather than to the foregoing specification as indicating the scope of the invention.

We claim:

1. In a method of playing a game of Pai Gow Poker including a house which is the establishment operating the game and a dealer who is employed by the house and who deals the cards, wherein the dealer deals seven cards to himself, as a dealer/player of the game, and seven cards to each of a plurality of additional players of the game at least one of which is also designated as a banker, the banker/player being the player responsible for paying or collecting from each of the players, the improvement wherein each of the additional players is first given the option prior to the cards being dealt of placing a wager against either the house or the banker/player.

2. The improvement as claimed in claim 1 wherein each of the additional players may first place a bet against either the house or the banker/player or both the house and the banker/player.

* * * * *